US005946782A

United States Patent [19]

Dubugnon et al.

[11] Patent Number: 5,946,782

[45] Date of Patent: Sep. 7, 1999

[54] TOOL FOR MAKING JOINTS BETWEEN SHEET-FORMED MEMBERS

[76] Inventors: Olivier Dubugnon, Vullierens; Jean-Claude Faivre, Renens, both of Switzerland

[21] Appl. No.: 08/793,849

[22] PCT Filed: Jul. 11, 1996

[86] PCT No.: PCT/EP96/03059

§ 371 Date: Mar. 10, 1997

§ 102(e) Date: Mar. 10, 1997

[87] PCT Pub. No.: WO97/02912

PCT Pub. Date: Jan. 30, 1997

[30] Foreign Application Priority Data

Jul. 11, 1995 [SE] Sweden ..... 9502587

[51] Int. Cl.[6] ..... B21D 39/03

[52] U.S. Cl. ..... 29/21.1; 29/243.5

[58] Field of Search ..... 29/21.1, 243.5, 29/521, 522.1, 798

[56] References Cited

U.S. PATENT DOCUMENTS 4,028,370 6/1977 Eckold ..... 29/21.1

4,064,617 12/1977 Oaks ..... 29/798

5,509,290 4/1996 Faivre ..... 29/21.1

5,528,815 6/1996 Webb ..... 29/243.5

*Primary Examiner*—Daniel C. Crane

*Attorney, Agent, or Firm*—Mark P. Stone

[57] ABSTRACT

A tool for making joints between sheet-formed members (4, 5) comprising a first tool-part (1, 2, 3) with a punch (1) and a side pressing element (2) and a second tool-part(6 ,11) provided with a support surface (9) from which an anvil (8) erects, a matrix (6') comprising at least two matrix-parts (6) each having an upper active matrix surface (13) and being arranged around said anvil (8). Each matrix part comprises a portion (14) arranged sliding against said support surface (9) and being applied against the lateral surface of said anvil (8) by means of elastic means (7). Retention means (10) are arranged limiting the longitudinal movement of the matrix parts during the retraction of the punch (1). The upper active matrix surface (13), the portion (14) arranged sliding against said support surface (9) and said retention means (10) are arranged in that order from the top of the second tool-part (6, 11).

1 Claim, 3 Drawing Sheets

TOOL FOR MAKING JOINTS BETWEEN SHEET-FORMED MEMBERS

This application is a 371 of PCT/EP96/03059, filed Jul. 11, 1996.

The present invention refers to a tool for making joints between sheet-formed members, metal or non-metal.

The invention concerns more specifically a tool which can be used in a joining operation carried out on at least two sheet-formed members, e.g metal sheets. By means of a co-operating punch and matrix the members are joined together by drawing the material in the sheets forming a cavity in the sheets and laterally extending the bottom part of said cavity to lock the members to each other.

It is known from the prior art tools in which the matrix comprises at least two matrix-parts which at one end-portion co-operates with an anvil and at the other end-portion are arranged sliding on a support surface against the forces from an elastic member. A stop means is arranged to limit the lateral moment of the matrix-parts. The elastic members are generally constituted by a ring made of an elastomer surrounding the matrix-parts.

When the joint has been made and the punch is retracted the matrix elements are exposed to longitudinal forces which tend to pull the matrix parts out of position. The matrix elements therefore have to be secured to the anvil body. In a tool according to prior art stop means for the lateral movement of the matrix-parts comprises a solid ring surrounding these parts. This ring is also used for keeping the matrix-parts in place when the punch is retracted. This arrangement has the disadvantage that the lateral dimensions of the matrix will be large and the assembly and disassembling of the matrix will be complicated and time consuming.

In another tool according to prior art the matrix parts are inclined against the anvil and the lower surfaces of the matrix elements are sliding against a horizontal support surface on the anvil body. Due to the large distance between the top surface of the matrix elements, exposed to the forces from the sheet-formed material, and the opposite surface where the sliding takes place the sidewalls of the matrix parts in between these opposite surfaces of the matrix parts have to be of considerable thickness. This means that the matrix will have large dimensions in the lateral direction.

One of the objects of the present invention is to avoid the inconveniences with a large matrix. It is obviously of great value especially when making joints where the space is limited to have a compact tool with small dimensions.

The tool according to the invention makes joints between sheet material, and comprises a first tool-part with a punch and a side pressing element and a second tool-part provided with a support surface from which an anvil erects. A matrix comprising at least two matrix-parts is arranged around said anvil, each matrix-part comprising a portion arranged sliding against said support surface and being applied against the lateral surface of said anvil by means of elastic means. Means for guiding the matrix-parts during the sliding movement could be provided.

In order to keep the lateral dimensions of the matrix small the distance between the top surface and the sliding surface of the matrix elements is made small according to the invention. This means less stress on the material and a possibility to use less material in the matrix parts. The corresponding support surface where the sliding movement between the matrix parts and the anvil body takes place is consequently arranged higher up on the anvil body. This will result in less tendency of tilting for the respective matrix element when the forces from the sheet-formed material is increasing. Additionally the retention of the respective matrix-parts can be arranged in a very favourable way on the lower side of a ring-formed element the top surface of which constitutes the support surface for the matrix elements. The lower part of the matrix elements are in a preferred embodiment not in contact with any surface in the longitudinal direction of the tool to take up any forces during the formation of the joint. During the returning movement of the punch, however, a flange on each matrix element close to the lower part of the element is limiting the longitudinal movement in the same direction as the punch. As the force exercised on this flange during the upward motion of the element is very low compared to the compression force on the matrix during the formation of the joint, the thickness of the wall linking the upper and lower parts of the matrix element can be made very small with a direct and very favourable effect on the diameter of the matrix.

Due to the fact that sliding surface has been moved higher up on the anvil body in relation to known tools the vertical dimension of the active part of the anvil is correspondingly smaller which means a mechanically much more resistant anvil.

According to a further characteristic the elastic means which applies the matrix-parts against the lateral surface of the anvil is constituted by an elastic ring arranged at the bottom of the waist of the matrix-parts.

In a preferred embodiment the retention means on each martix part is forming an integral part of the martix part which is made in one piece, of the same material.

Additional characteristics and advantages will be apparent from the reading of the following description which is given by way of example of a few advantageous embodiments of the tool according to the invention with reference to the drawings on which, FIG. 1 shows a tool according to the invention in a position at the start of the joining procedure.

Figure 10:
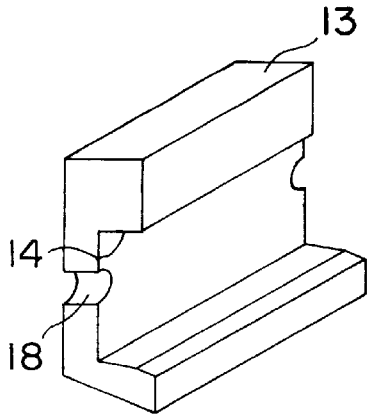
Figure 11:
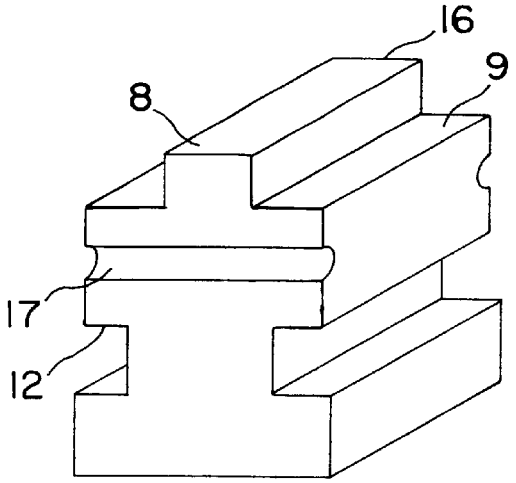

FIG. 10 and 11, finally, show an embodiment having a square anvil top surface.

Figure 1:
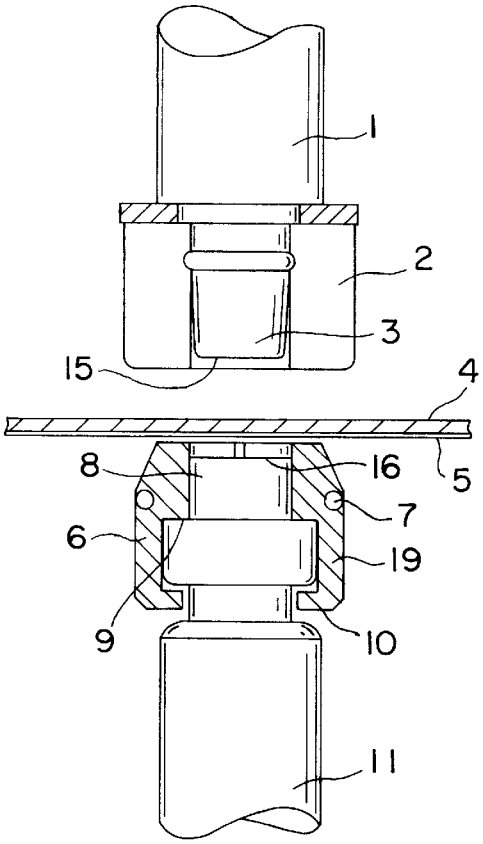

FIG. 1 shows a punch 1 having a resilient side pressing element 2 arranged around its tip portion 3. A generally flat horizontal surface 15 of the punch will be brought into contact with the upper sheet formed member 4 when the punch is approaching the matrix-anvil part of the tool. The sheet formed members rest on the top surface of four identical matrix parts 6 forming the matrix 6'. These matrix part are surrounding an anvil 8 having a generally flat top surface 16. The matrix parts are held together by means of a resilient means 7 arranged in a grove on the surface of the matrix parts between the top surface 13 (FIG. 3) and the inner sliding surface 14 on the respective matrix part. A generally flat and horizontal co-operating sliding surface 9 is arranged on the anvil body 11 forming the top surface of a ring-formed element on said body. Side wall elements. 19 are linking the upper part of the matrix element with an inner flange at the lower part of the element. This flange is extending inwardly, laterally around the lower part of said ring formed element thereby gripping around the same and preventing the dislocation of the matrix during the returning movement of the punch. The compression forces are all taken up by the sliding surface 9 on top of the ring formed element. It is evident that only very small forces will be acting on the lower flange during the returning movement of the punch. This means that the side wall portions 19 can be made very thin which means that the diameter of the matrix will be very small.

In this particular embodiment the upper part of the matrix has been given a slightly conical form to decrease the diameter further at the top of the matrix.

Figure 2:
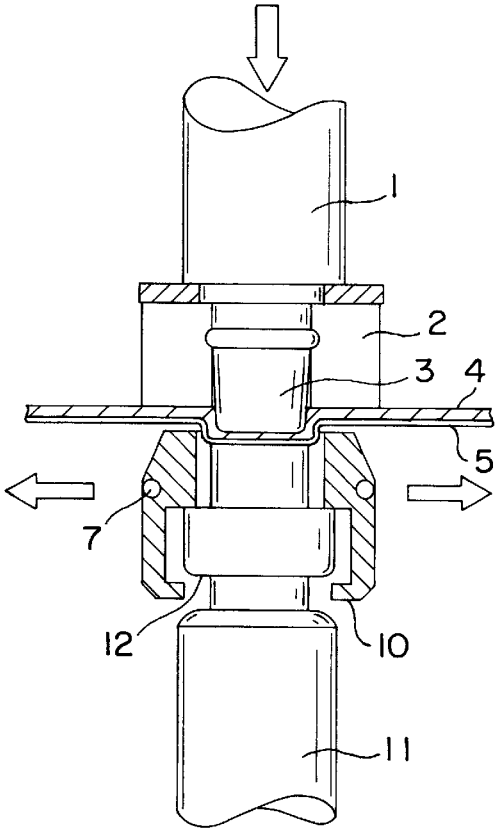
FIG. 2 shows the same tool at the end of the joint forming stroke.

In FIG. 2 the punch has formed the joint co-operating with the matrix and the anvil. During the lateral expansion of the material due to the compression forces between the punch 1 and the anvil 11, the matrix parts 6 are sliding outwards essentially without tilting against the counter force from the resilient means 7. During the returning movement of the punch and the joint from the matrix the flanges will hook under the ring formed element on the anvil body and prevent the matrix from being dislocated.

Figure 3:
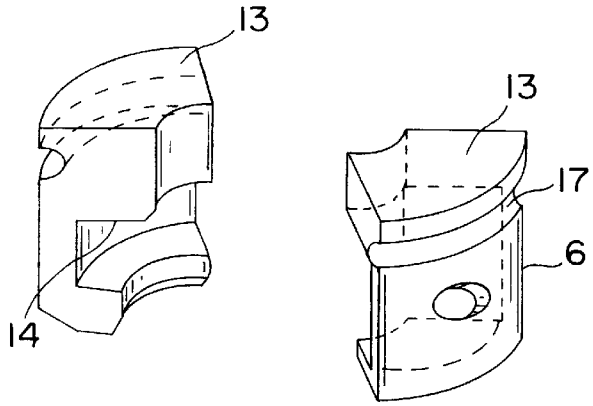
FIG. 3 shows in a perspective view two matrix parts according to the invention.
Figure 4:
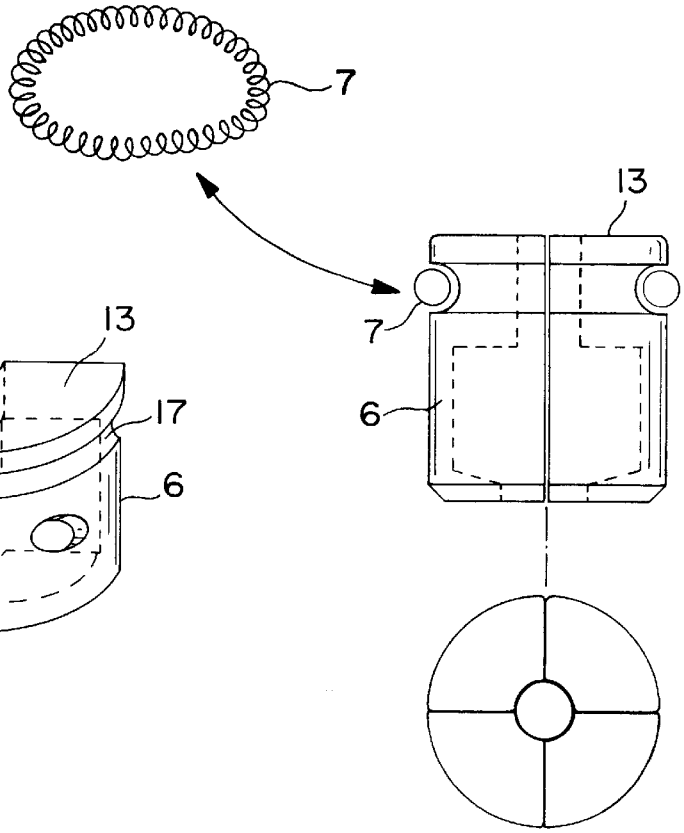
FIG. 4 shows a matrix assembled of four identical matrix parts and an example of the resilient means surrounding the matrix parts.

In FIG. 3 and 4 the matrix 6' is constituted by four identical matrix-parts 6 which at one end-portion have a support surface 13 for the sheet members 4, 5. Essentially parallel to the surface 13 an inner surface 14 on the matrix-part is arranged to co-operate with the support surface 9 on the anvil body. To keep the matrix parts together around the anvil a resilient means 7 in the form of a toroid formed spring is arranged in a groove 17 arranged on each matrix part.

Figure 5:
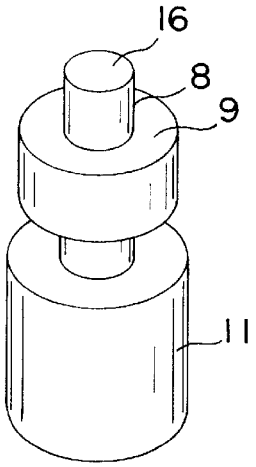
FIG. 5 shows an example of an anvil body according to the invention.
Figure 6:
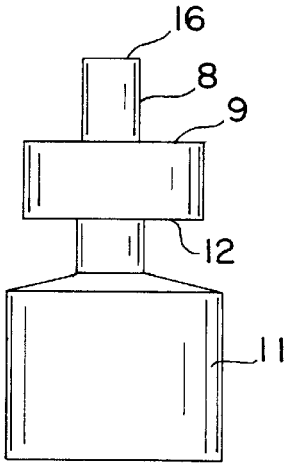
FIG. 6 and 7 show two other embodiments of the anvil body according to the invention.
Figure 7:
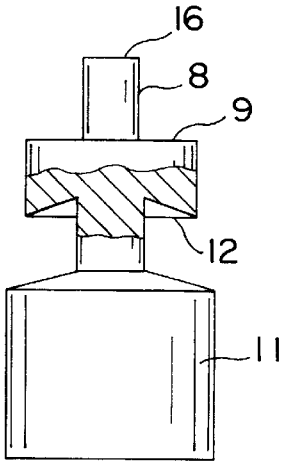
Figure 8:
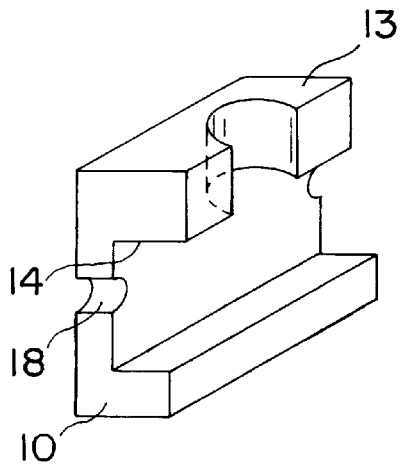
FIG. 8 and 9 show parts of a further embodiment of the tool according to the invention.
Figure 9:
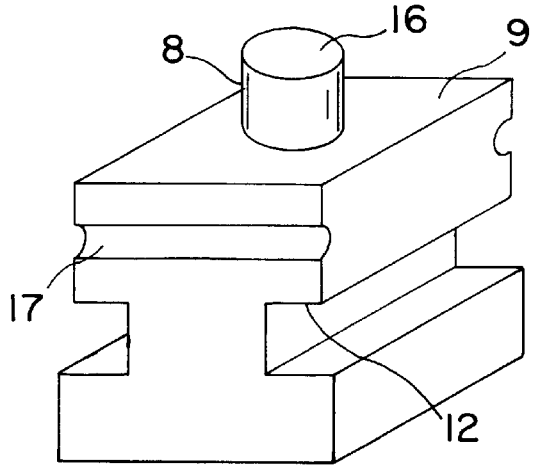

FIGS. 5 to 7 show different embodiments of the anvil body 11. The top portion is the same in the three examples. In FIG. 7 the lower surface of the ring formed element on the anvil body has a conical form to decrease the risk for the matrix parts to dislocate longitudinally during the returning movement of the punch. With a suitable co-operating design of the flange the hooking effect could obviously be made more secure.

In FIGS. 6 and 7 the surface opposite to the lower surface of the ring-formed element on the anvil body has been made conical to minimise the risk that a matrix part will break due to tilting.

The same basic inventive idea can also be used for tools with a generally rectangular form of the anvil body and the matrix parts. In this embodiment the matrix comprises only two parts. The active part of the anvil 8 has the same section as described above. The resilient means 7 will in this example take a rectangular form. Additional groves 17 have been arranged on the side walls of the anvil body which will additionally secure the matrix parts during the returning movement of the punch. In the limit case the flanges which here are rectilinear could be disposed of.

The FIGS. 10 and 11 show a co-operating anvil body and matrix part for a configuration having a generally rectangular active anvil part 8.

We claim:

1. Tool for making joints between sheet-formed members, metal or non-metal, comprising a first tool-part (1, 2, 3) with a punch (1) and a side pressing element (2), and a second tool-part (6, 11) provided with a support surface (9) from which an anvil (8) extends, a matrix (6') comprising at least two matrix-parts (6) each having an upper active matrix surface (13) and being arranged around said anvil (8), each matrix part comprising a portion (14) arranged sliding against said support surface (9) oriented substantially perpendicular to a lateral surface of said anvil, being applied against the lateral surface of said anvil (8) by elastic means (7) and being provided with retention means limiting the longitudinal movement of the matrix parts during retraction of the punch (1), wherein the upper active matrix surface (13), the portion (14) arranged sliding against said support surface (9), and said retention means are all fixed relative to one another and are arranged in that order from the top of the second tool-part (6, 11).

* * * * *